US006802576B2

(12) United States Patent
Shepherd

(10) Patent No.: US 6,802,576 B2
(45) Date of Patent: Oct. 12, 2004

(54) PROTECTED DISPLAY CASE

(76) Inventor: Bradley D. Shepherd, 4671 Yorba La., Yorba Linda, CA (US) 92886

( * ) Notice: Subject to any disclaimer, the term of this patent is extended or adjusted under 35 U.S.C. 154(b) by 0 days.

(21) Appl. No.: 10/021,386

(22) Filed: Oct. 26, 2001

(65) Prior Publication Data

US 2003/0080653 A1 May 1, 2003

(51) Int. Cl.[7] ..... A47F 3/00

(52) U.S. Cl. ..... 312/117; 312/114; 312/138.1; 312/319.7

(58) Field of Search ..... 312/114, 117, 312/118, 126, 128, 319.5, 319.7, 306, 312; 108/147, 144.11; 109/45, 47

(56) References Cited

U.S. PATENT DOCUMENTS 4,065,194 A * 12/1977 Mattia ..... 312/247
4,929,862 A 5/1990 Hamilton et al.
5,165,768 A * 11/1992 Zarrabi et al. ..... 312/114
5,733,021 A 3/1998 O'Neill et al.
5,791,749 A 8/1998 O'Neill et al.
5,853,235 A * 12/1998 Barnes ..... 312/117
6,540,311 B2 * 4/2003 Canedy et al. ..... 312/114

FOREIGN PATENT DOCUMENTS

DE 3825402 * 1/1990 ..... 312/319.7

OTHER PUBLICATIONS

Declaration of Mr. Brad Shepherd regarding experimental; use of one embodiment of invention.

* cited by examiner

*Primary Examiner*—James O. Hansen
(74) *Attorney, Agent, or Firm*—Harold L. Jackson

(57) ABSTRACT

A protected display case for securely displaying items and for securely storing the items out of view. The display case having a top section that has at least one transparent window and a bottom section. A lifting mechanism raises and lowers a shelf containing items for viewing. The lifting mechanism uses a motor, a gear assembly, and at least two guides that are spaced apart and fixed in a vertical position. The shelf travels up or down in relation to the guides. In the raised position, the items are in the top section and on display for viewing by way of at least one shatter resistant viewing window. In the lowered position, the items are stored within the bottom section and a panel assembly creates a barrier between the top and bottom sections.

13 Claims, 7 Drawing Sheets

PROTECTED DISPLAY CASE

BACKGROUND OF THE INVENTION

1. Field of the Invention

This invention relates to a protected display case for securely viewing and storing items such as jewelry, cameras, and guns.

2. Description of the Prior Art

A large variety of valuable items are routinely placed on display in stores to attract customers. Jewelry is one of the better known examples of such items. In the case of jewelry, and particularly for expensive jewelry, the display of the items creates a number of serious issues.

First, there is the issue of control over the items. If expensive jewelry is on display, the owner wants to be sure that the jewelry cannot be accessed by anyone other than authorized store personnel. Even then, the owner may want access to the jewelry by store personnel restricted to certain times and under certain conditions.

Another issue concerns moving the jewelry. More expensive jewelry may be moved from the display case to a vault for storage when the store is not open for business. In these situations there is the possibility of damage to the jewelry in the transportation process. Also, there is the chance that some jewelry may be lost and/or mis-marked during transport. Finally, it takes time to move the jewelry from the vault to the display and vice versa. The store must usually be closed during the setup process and the employees are being paid for their time while there are no customers in the store.

The last, but certainly not the least, concern is for security. Should a robbery occur, the items need to be safe even when on display.

In response to the need for a secure display case, a number of solutions have been developed. Some display cases incorporate break resistant glass, or another type of transparent material, so that the items on display can be viewed while still being more secure than with just plain glass viewing windows. While this is an improvement, it does not stop access to the item from behind the display case where the items are typically removed.

Another innovation was the use of a folding shield as identified in U.S. Pat. No. 4,929,862 to Hamilton et al ("Hamilton"). In that patent, a flexible cover can be drawn over the items. The cover is comprised of a tamper resistant material and thus makes it difficult for a potential thief to access the items. There are two disadvantages to this solution.

First, the cover is moved manually. During operating hours, the cover is not in position to protect the items on display. If a robbery occurs during this time, the employees will not have the opportunity to put the cover in place.

Secondly, the narrow front panel that is intended to add security also narrows the range of view for the items on display. It is of critical importance to have the merchandise on display visible as much as possible to potential customers. When that range is diminished, then to some degree sales must suffer. That is an unacceptable consequence especially in the jewelry business.

Another idea combines a shield and a moving display tray. In U.S. Pat. No. 5,733,021 to O'Neil et al ("O'Neil I") a solid shield and a scissor type moving apparatus are used. First, the scissor device moves the display items from a viewing position in the top of the display case to a more secure position in the bottom of the display case. Once the items are in the bottom of the display case, a solid shield can be inserted between the top and bottom sections to prevent access to the items from the top of the case. This has two disadvantages.

First, the scissor mechanism is not a reliable or stable means for moving the display tray. As the scissor mechanism raises the tray, the ends of the arms of the scissors on the tray come closer together. As a result, the support for the tray is not at the ends where it is most effective, but somewhere between the middle and the end. Therefore, the tray is not as stable as it would be if there were supports at the opposing ends.

In the case where the scissor arms are fully extended vertically then the display tray is supported at virtually two points. This is very unstable. In the case where the arms are about horizontal, it is difficult to operate the scissor and to raise the display case. This is due to the fact that the scissor can fail to operate when the arms are fully horizontal. In this position, more force is required to move the arms than if the arms were in a more vertical position. It is a characteristic of the scissor device.

Secondly, the movement of the tray does not occur in a steady or failure free manner. With only one motor being used, all of the joints in the scissor device tend not to respond to the forces involved at the same time. This makes for an inconsistent movement of the display tray that has its own disadvantages. Due to the nature of the scissor apparatus, there is no guarantee that the tray will be in the same horizontal position in the raised and lowered positions each time it is operated. This affects the esthetic character of the items on display since the display tray may not be flush with the rest of the display area. It is also likely that if a item, such as a piece of jewelry, were dislodged from its display position and fell into the bottom part of the case, then the scissor mechanism may crush or mangle the item as the scissor mechanism operates. In the case of valuable jewelry, this could be a disaster.

Lastly, the cover has the same disadvantages as found in the Hamilton patent. In particular, the cover in the "O'Neil I" patent must be manually inserted. When there is a robbery attempt in progress, the employees will not have the time or opportunity to first lower the tray and then manually install the shield. This is compounded by the fact that neither the Hamilton nor "O'Neil I" patents claims a break resistant viewing material in conjunction with the security systems. Thus, when the security divider is not in place, there is an opportunity for the display window to be shattered and the items on display removed.

U.S. Pat. No. 5,791,749 to O'Neil et al ("O'Neil II") is drawn to a secured display case, but also suffers from the infirmities of the O'Neil I and Hamilton patents.

First, the "O'Neil II" patent claims an obscuring closure for covering the opening between the top and bottom of the display case when the items are in the bottom of the case. This obscuring closure is operated by a hand crank system. The reason, disclosed in the patent, for this procedure is that the items are to be put on display each morning and secured at night. Thus, employees have the time to perform the manual operation. There is no mention as to the device operating during an attempted robbery while the store is open or the use of a motor to operate the obscuring closure.

SUMMARY OF THE INVENTION

The invention is directed to a protected display case for securely displaying items and for storing the items when not on display. The display has a top and bottom section, an access opening between the top and bottom sections, a shelf to hold items, a lifting mechanism, and a movable panel assembly.

The lifting mechanism has at least two guides spaced apart and fixed in vertical locations, a motor, and a gear assembly. The lifting mechanism raises the shelf in relation to the guides to a position where the items are within the top section and viewable to customers and lowers the shelf where the items are stored within the bottom section and not viewable. When the shelf is in the lowered position, the movable panel assembly covers the access opening thereby securing the items within the bottom volume.

BRIEF DESCRIPTION OF THE DRAWINGS

FIG. 10*a* is a side view of the take-up reel.

FIG. 10*b* is a side view of the nut assembly.

FIG. 10*c* is a side view of the lead screw cog and chain.

FIG. 10*d* is a top view of the lead screw cog and chain.

DETAILED DESCRIPTION OF THE DRAWINGS

Figure 1:
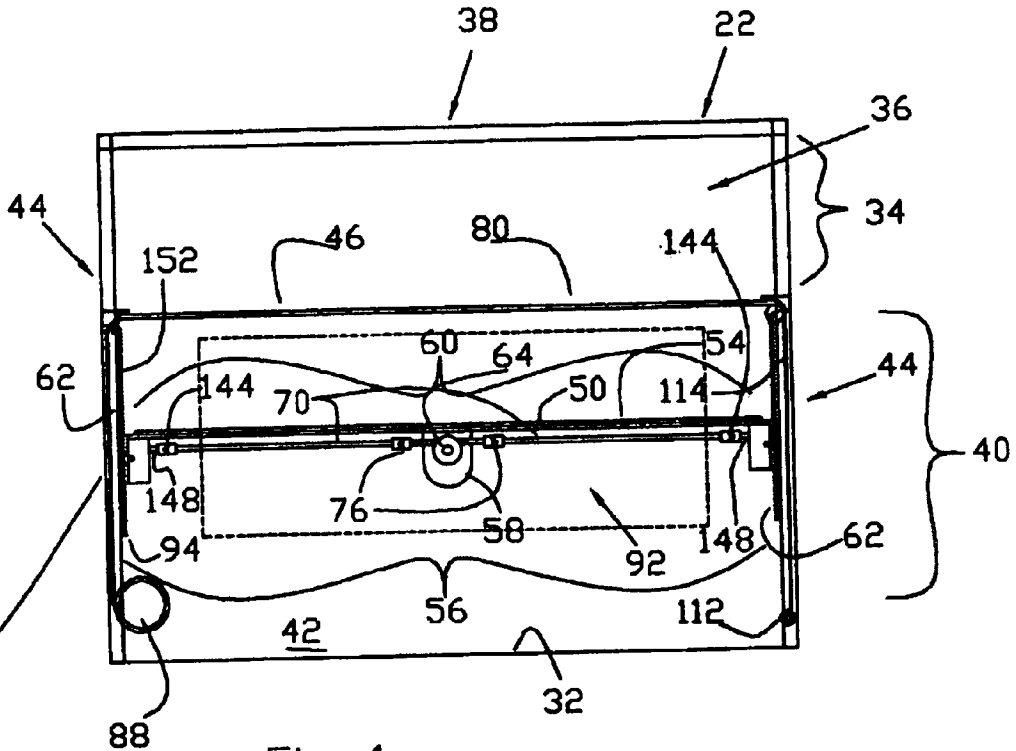
FIG. 1 is front view of a protected display case, absent the front peripheral covering side, showing the display shelf and lifting mechanism in lowered position.

The present invention may best be understood by reference to the following description taken in conjunction with the accompanying drawings. FIG. 1 is a front view of a protected display case 22 having a peripheral wall 44 (removed from the front in FIG. 1) defining a top section 34 with a top volume 36, a bottom section 40 defining a bottom volume 42, and bottom 32. The peripheral wall of the bottom section 40 is composed of a penetration resistant material such as hardened steel in the form of four panels suitably secured together. The top section 34 has at least one viewing window 38. The viewing window 38 is preferably comprised of a breakage resistant material such as tempered or bullet proof glass. Between the top volume 36 and the bottom volume 42 is an access opening 46. See FIGS. 2–4. Items on the shelf 50 are disposed within the top volume 36 when on display and are stored in the bottom volume 42 when not on display.

As an option, the shelf 50 can have a band 48 positioned about the edge of the shelf 50, the band bending in response to an obstruction such that items would not be crushed when the shelf 50 is raised. See FIG. 1*a*. In this configuration, an obstruction between the shelf and the access opening, such as an item of jewelry, would not be crushed. The shelf 50 is raise and lowered by a lifting mechanism 56, to be described, and there is at least one door 92, show in dashed lines, mounted on the front side panel for accessing the items.

In FIG. 1, the lifting mechanism 56 has a pair of upstanding and spaced apart guides 62 at opposite ends of the shelf 50. Each guide 62 is disposed along or adjacent the peripheral wall 44. Each guide 62 in FIG. 1 is aligned along a longitudinal axis 94 and in the embodiment of FIG. 1 includes a track 100 having track teeth 152. The track is adapted to cooperate with a gear 108 such as a cogwheel. The gear 108 is rotatable about an axle 168. Each guide 62 is in a substantially vertical position, i.e., are thus aligned vertically.

Figure 1A:
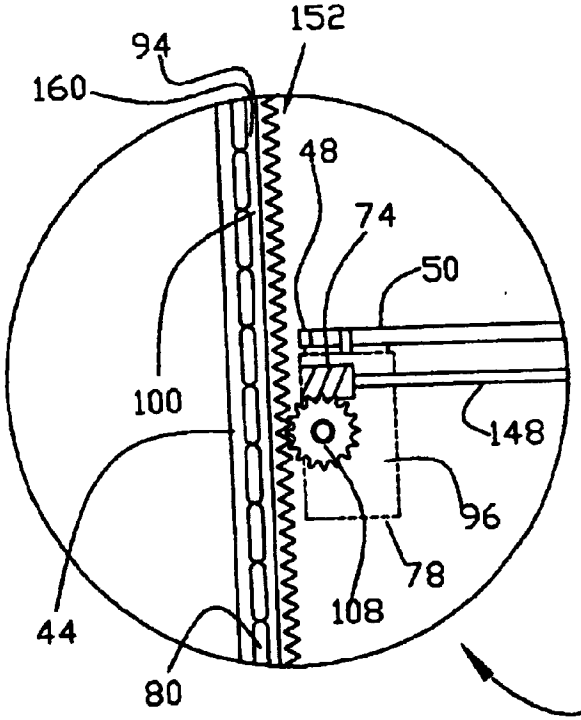
FIG. 1*a* is a close-up view of one of the movable shelf support and accompanying elements.

FIG. 1*a* shows the track teeth 152 working in cooperation with the gear 108. The gear 108 is rotatably mounted within a gear housing 96. As a rod 148 (second rod) turns, a worm gear 74 carried thereby rotates and this rotation causes the gear 108 meshed with the worm gear 74 to turn, which results in the gear 108 moving up or down along the track 100. The gear 108, worm gear 74, and gear housing 96 form a movable shelf support 78. The gear housing 96 is secured to the bottom of the shelf 50 and as a result, the shelf 50 moves in relation to the guide 62 when the gear 108 rotates.

Returning to FIG. 1, the rod 148 that is connected to a coupling 144 that in turn is connected to another rod 70 (first rod). The rod 70 is connected to a U-joint 76 that is connected to a gear box 64. A motor 58 drives the gear box 64, which in turn rotates the U-joint 76, first rod 70, coupling 144, rod 148, and worm gear 74. As explained, the worm gear 74 is secured in the gear housing 96 such that the worm gear 74 is free to rotate but is in a fixed position relative to the gear housing 96 to allow for constant contact between the worm gear 74 and the gear 108. The movable shelf support 78, U-joint 76, rod 70, coupling 144, and gear box 64 comprise the gear assembly 60 in FIG. 1. Thus, operation of the motor 58 activates the gear assembly 60 resulting in the shelf 50 being raised or lowered.

Figures 2, 3, 4, 5:
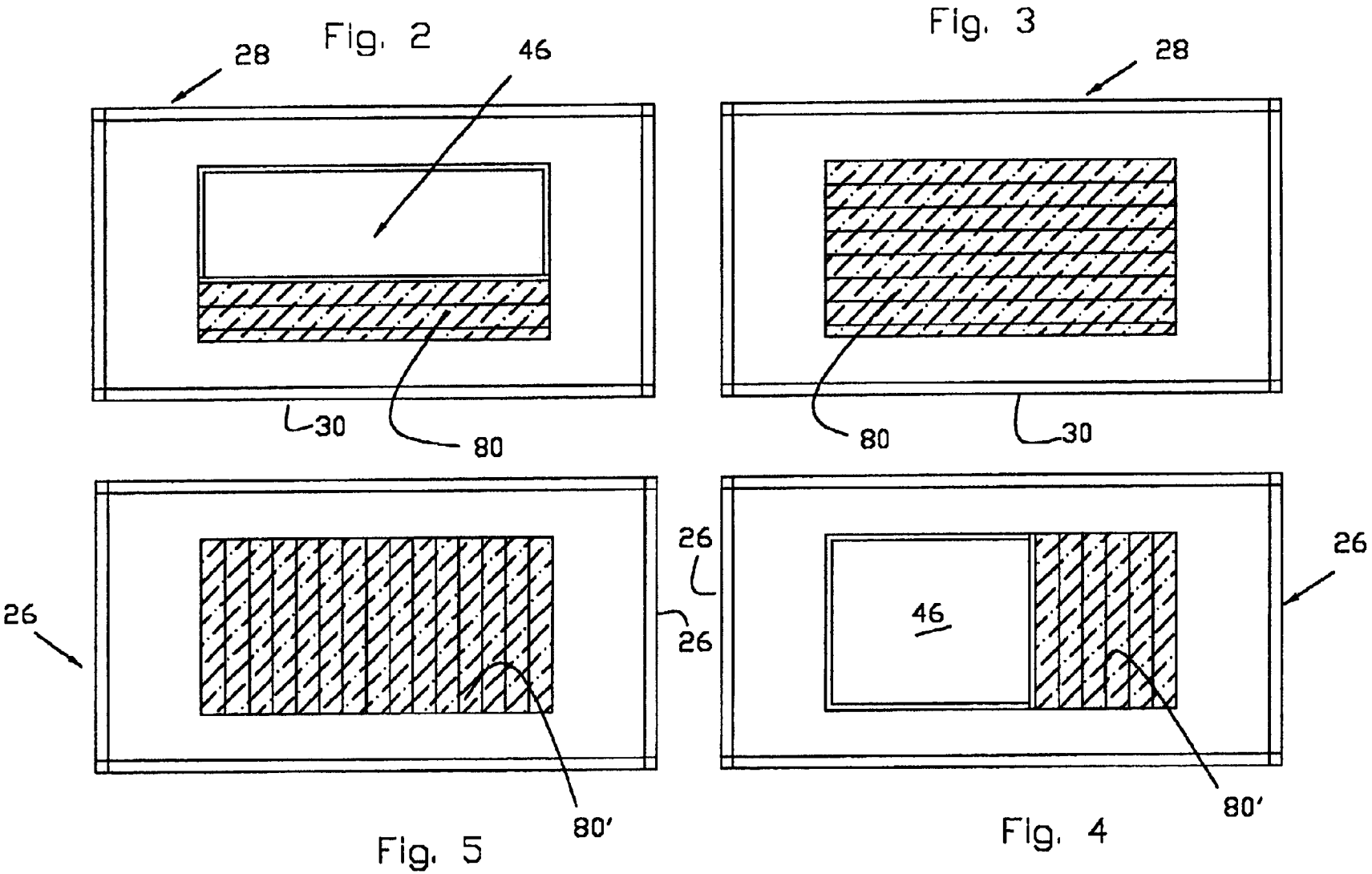
FIG. 2 is top view of a protected display case of FIG. 1 with the movable panel assembly moving from back to front and partially covering the access opening
FIG. 3 is a top view of the protected display case of FIG. 1 with the movable panel assembly fully covering the access opening
FIG. 4 is top view of an alternate embodiment of the protected display case with the movable panel assembly moving from side to side and partially covering the access opening
FIG. 5 is top view of the protected display case of FIG. 4 with the movable panel assembly moving from side to side and fully covering the access opening

FIG. 2 is a top view of the protected display case 22 showing a movable panel assembly 80 partially covering the access opening 46, which depicts the movable panel assembly 80 during the process of opening or closing. When the shelf 50 is extended such that the items are in their viewable position, the movable panel assembly 80 is in the open position. It is to be noted that the access opening may be considerably larger in comparison to the length and width of the display case than that shown in FIGS. 3–4.

FIG. 3 shows the movable panel assembly 80 fully covering the access opening 46. This is the closed position of the movable panel assembly 80, which occurs when the shelf 50 is within the bottom volume 42 and the items are stored out of view. In FIG. 4 and FIG. 5, a movable panel assembly 80' is displayed moving from the opposing sides 26. In this configuration, the movable panel assembly 80 is also stored on a roller assembly 88 as shown in FIG. 1.

A panel motor 112 is connected via a brake and reel (not shown) to a cord 114 which in turn is connected to the front end of the individually hinged panels 82 of the movable panel assembly 80. As the panel motor 112 draws the cord 114, the individually hinged panels 82 are drawn from the storage roller assembly 88 to cover the access opening 46. The roller assembly 88 is biased by a spring (not shown) and when the panel motor 112 and its associated reel and brake are not applying a force to the cord 114, then the individually hinged panels 82 are moved back and thereby uncovering the access opening 46.

Figure 6:
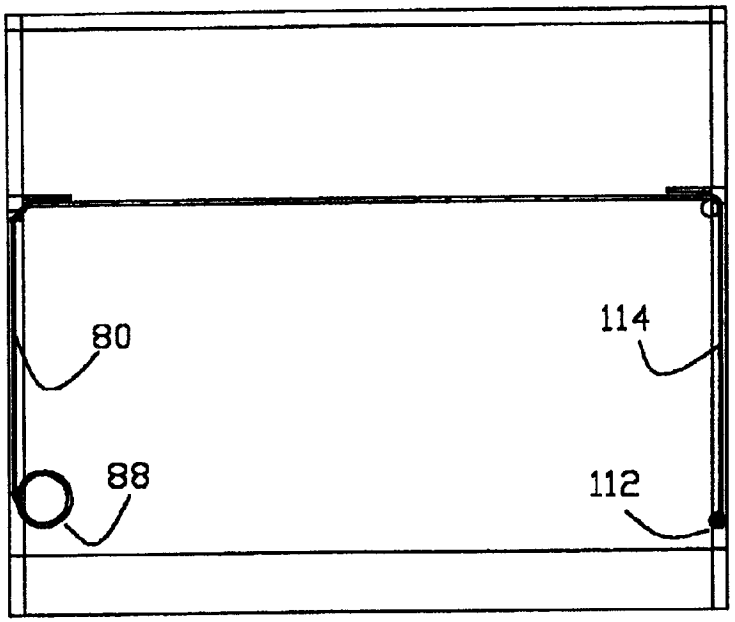
FIG. 6 is a front view of the protected display case of FIG. 1, absent the covering side and the lifting assembly, showing in more detail the reel for storing the moveable panel assembly positioned toward the bottom of the bottom section

FIG. 6 shows just the roller assembly 88 and associated elements.

Figure 7:
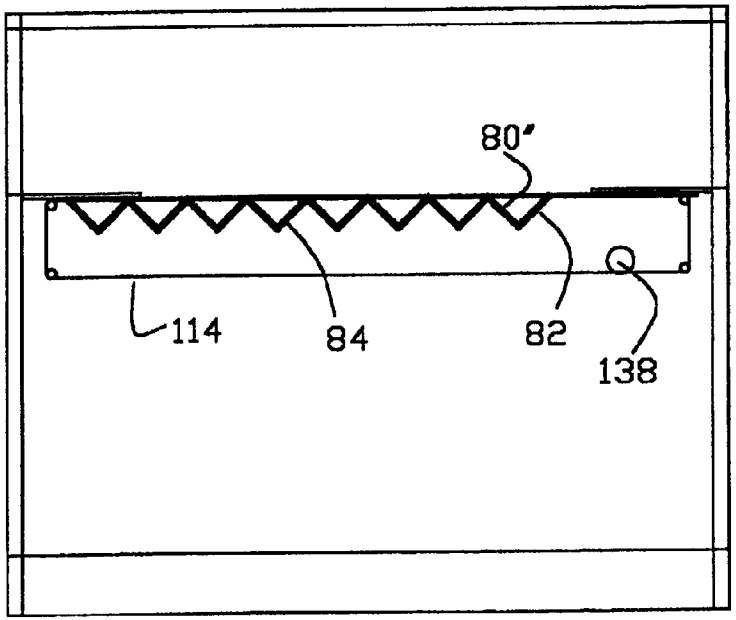
FIG. 7 is a front view of an alternative movable panel assembly in which the panel is movable from one side of the case to the other in an accordion like manner
Figure 9:
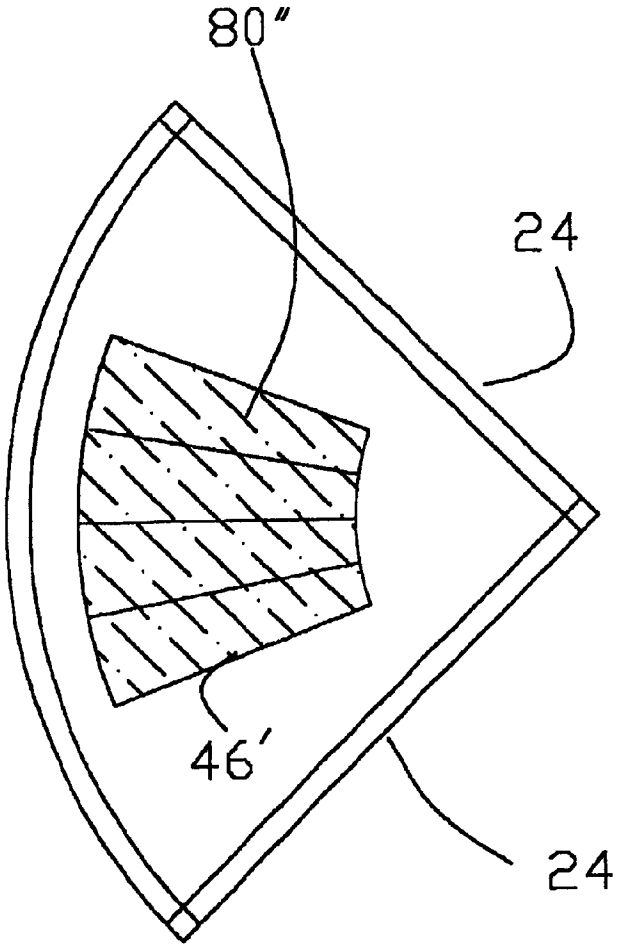
FIG. 9 is a top view of a protected display case of FIG. 8 with the movable panel assembly fully covering the access opening
Figure 8:
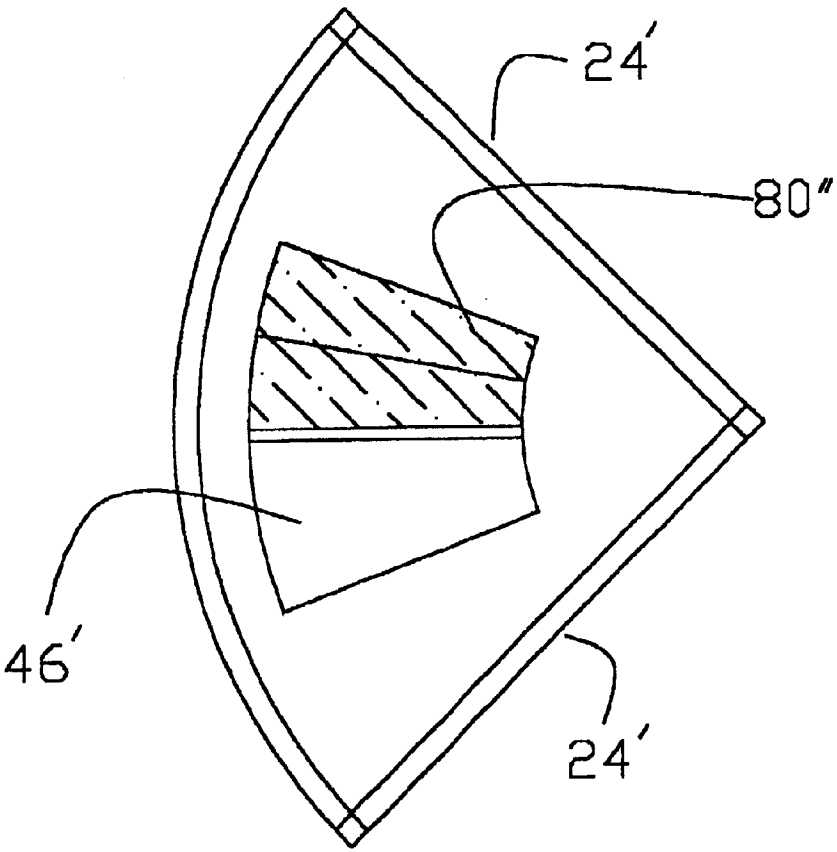
FIG. 8 is a top view of a protected display case where the sides of the case are not parallel and the movable panel assembly is partially covering the access opening

FIG. 7 shows a movable panel assembly 80' that does not utilize a spring biased roller assembly 88, but rather the individually hinged panels 82 are stored in an accordion like manner 84 adjacent one wall of the display case. The storage of panels in this fashion allows the movable panel assembly 80" to be used in applications where there may not be parallel opposing sides 26. FIG. 8 illustrates an embodiment where there are two sides 24' that are not parallel. The movable panel assembly 80' or 80" moves in an arc to cover the access opening 46. The movable panel assembly 80" is adaptable to situations where the opposing sides are parallel or not. FIG. 9 shows the movable panel assembly 80" covering the access opening 46, as when the shelf 50 is being stored out of view.

Figure 10:
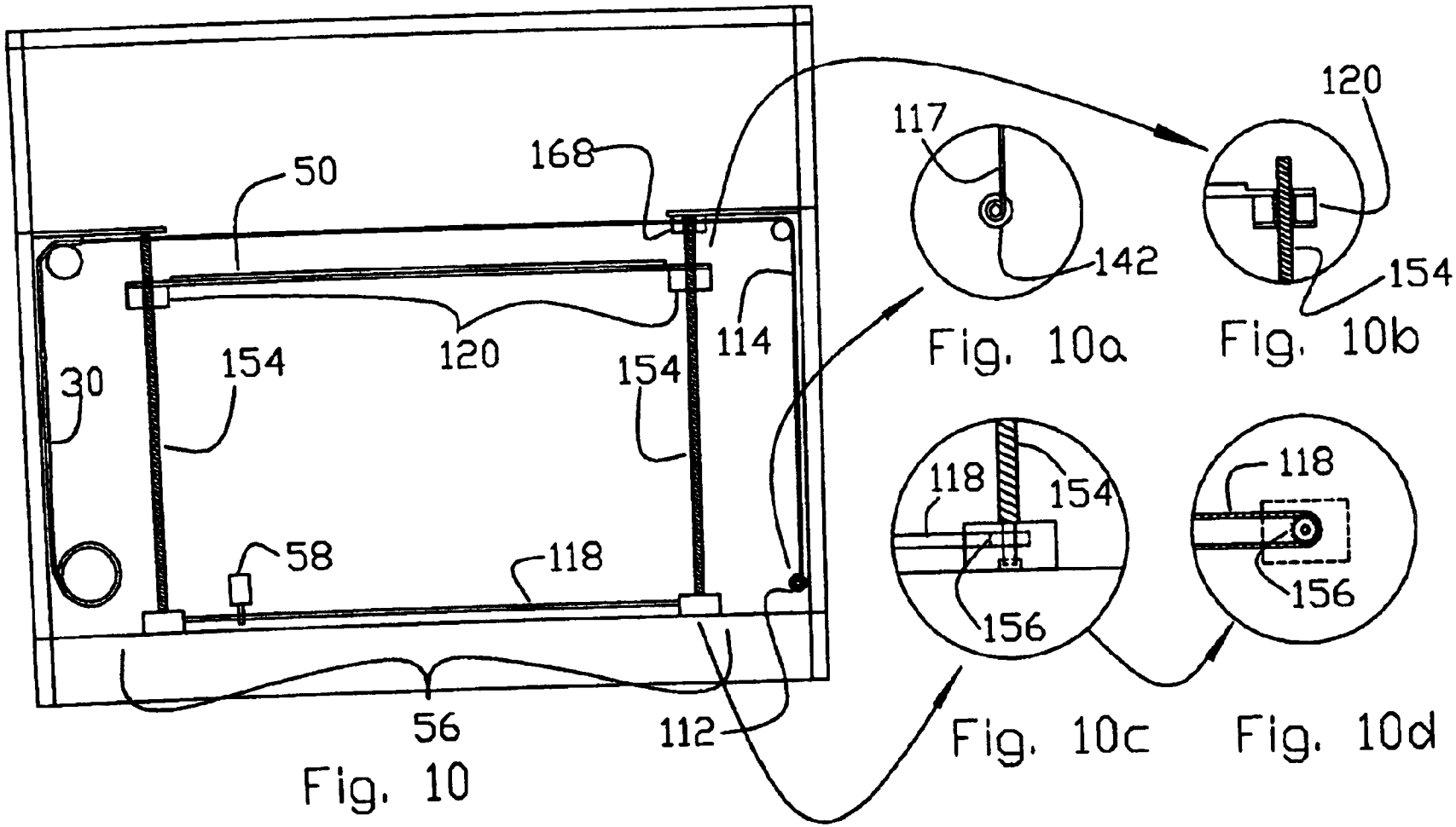
FIG. 10 is a front view of an alternative protected display case, absent the front covering side panel, illustrating the use of a lifting mechanism that uses a chain.

FIG. 10 illustrates an alternative lifting mechanism 56' that uses an endless chain 118, motor 58, at least one lead screw 154, and at least one nut assembly 120. When the motor 58 is operating it moves the chain 118 through a race track configuration. The chain 118 turns the lead screw 154 and the rotation of the lead screw 154 changes the height of the shelf 50 through the nut assembly 120 that is secured in place to the shelf 50. The lead screw 154 has a longitudinal axis and rotates about the longitudinal axis as the chain 118 turns the lead screw 154. The nut assembly 120 is a nut suitably secured to the shelf 50 so that the nut does not rotate.

FIG. 10*a* is a side view of the take-up reel 142 (driven by panel motor 112) that holds the cord 114 as the movable panel assembly 80 is moved from an open position 86 to a closed position 90 or vice-versa.

FIG. 10*b* is a side view of the nut assembly 120. The nut assembly 120 is in a relatively fixed position to the shelf 50 and moves up or down in response to the rotation of the lead screw 154 resulting in the shelf 50 moving up or down.

FIG. 10*c* is a side view of the chain 118 contacting the lead screw cog 156 secured to the bottom end of the lead screw 154. As the chain 118 moves, the lead screw 154 turns.

FIG. 10*d* is a top view showing a lead screw cog 156 secured to the lead screw 154. The chain 118 cooperates with the lead screw cog 156 such that as the chain moves, the lead screw cog 156 rotates, which in turn rotates the lead screw 154. The chain 118 and lead screw cog 156 form an alternative gear assembly 60 to that identified in FIG. 1.

Figure 11A:
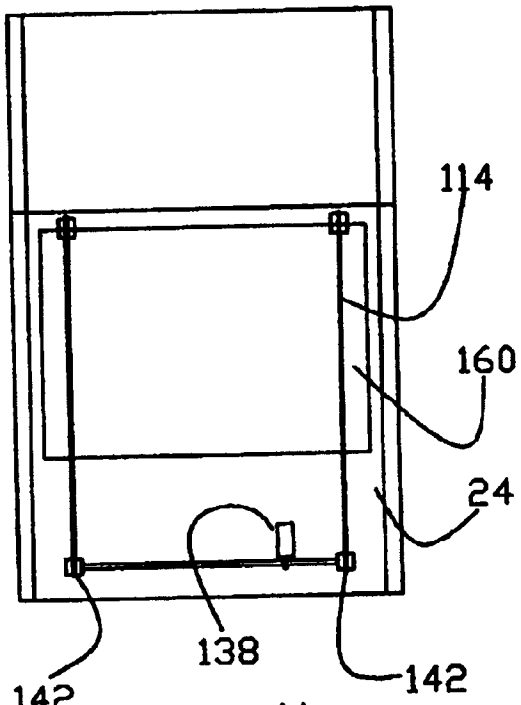
FIG. 11*a* is a side view of a protected display case of FIG. 11 with the covering side removed which supports the display shelf.
Figure 11:
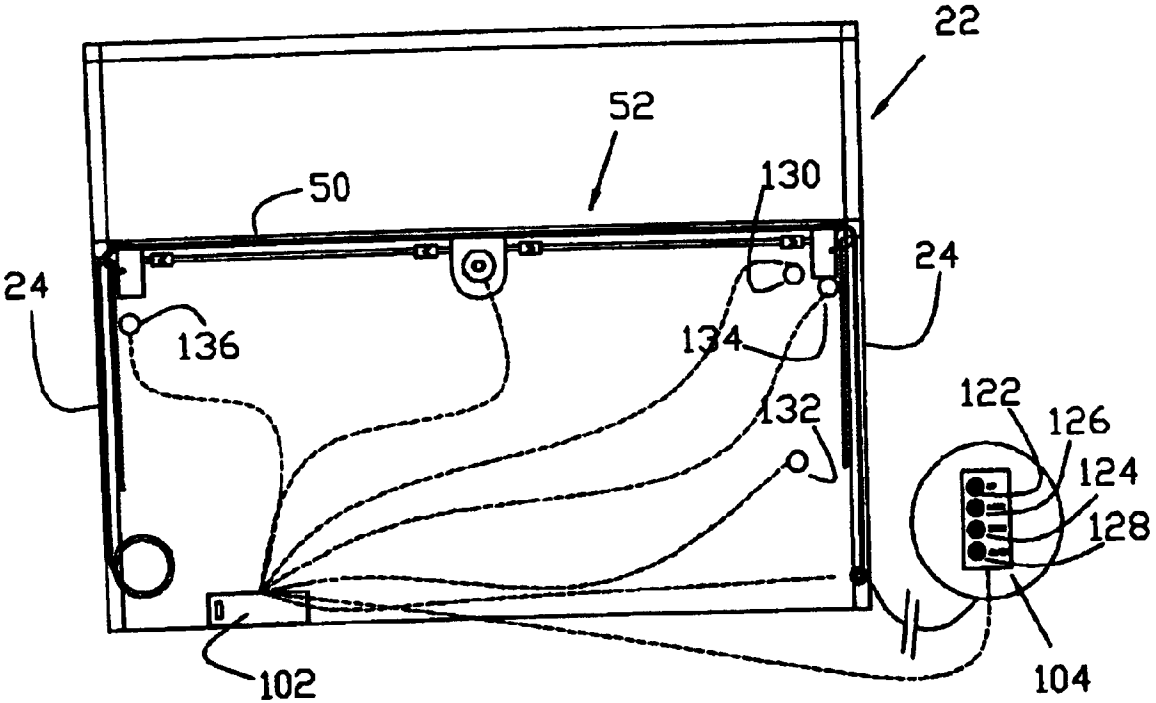
FIG. 11 is a front view of a protected display case of FIG. 1 with the display shelf in the raised position showing the electronics for operating the lifting mechanism and movable panel assembly.

FIG. 11 shows the computer access port 102 for connection to a computer (not shown) for operating and monitoring the protected display case 22. Also displayed is a manual control panel 104 for use by store personnel. The manual control panel 104 can include an up button 122, a down button 124, an alarm button 126, and a key lock 128. A switch 130 is activated when the shelf 50 is in the raised position 52 and stops the motor 58 from continuing to raise the shelf 50. Another switch 132 is activated when the shelf 50 is in the lowered position 54 and stops the motor 58 from continuing to lower the shelf 50. At some point while the shelf 50 is being lowered but before it is in the fully lowered position 54, the panel motor 138 is activated and the movable panel assembly 80 is moved to its closed position 90. A switch 134 is activated when the movable panel assembly 80 is in the closed position 90 and the panel motor 138 stops moving the movable panel assembly 80. In this configuration, the items are secured within the bottom volume 42.

At some point while the shelf 50 is being raised from its lowered position 54, the movable panel assembly 80 is retracted to its open position 86. This is accomplished by the roller assembly 88, which includes a spring to retract the movable panel assembly 80. A switch 136 is activated when the movable panel assembly 80 is in the open position 86. When the shelf 50 is in the raised position 52, the items are available for viewing by customers through the viewing window 38.

FIG. 11*a* is a side view of the protected display case 22 showing the panel motor 138 that drives the take-up reel 142, the track 100, and the rail support 160.

Figure 12A:
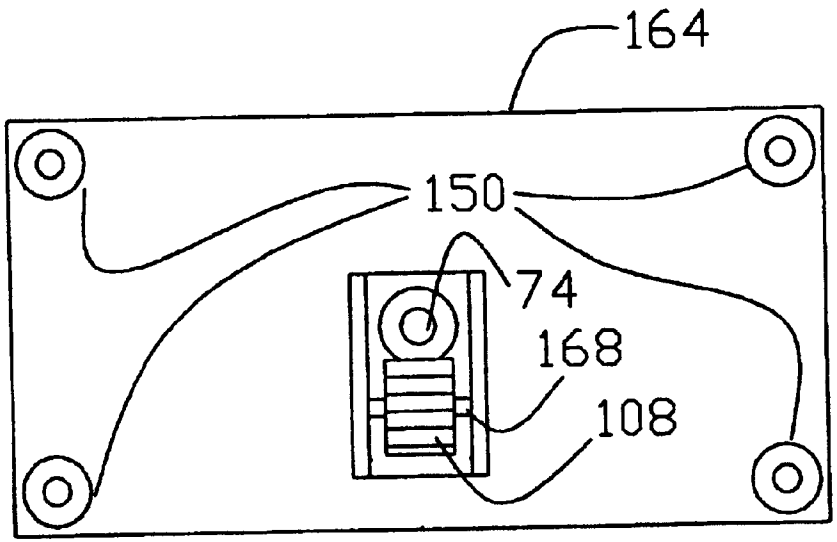
FIG. 12*a* is a front view of the carriage of FIG. 12.
Figure 12:
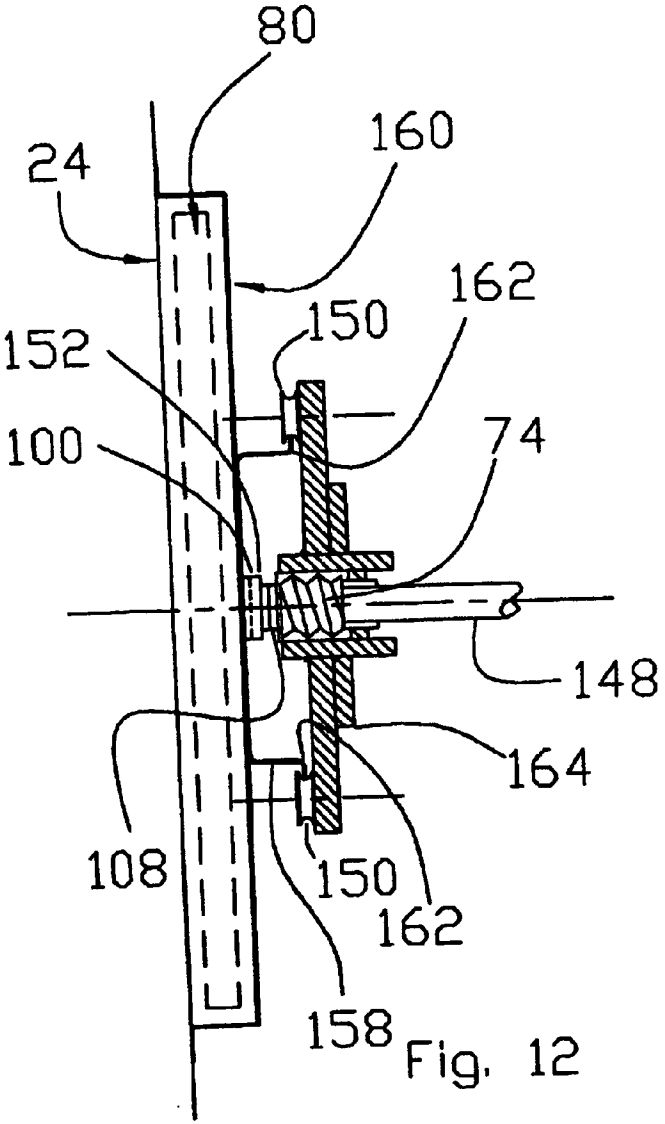
FIG. 12 is a top cross-sectional view of the carriage of FIG. 11.

Referring now to FIG. 12, one of the rail support 160 of FIG. 1 is shown in more detail connected a side 24 of the protected display case 22 such that there is formed a cavity that houses the movable panel assembly 80. A comparable worm gear 74 on the other side of the stabilizing assembly 166 houses the cord 114. A hat shaped rail 158 works in cooperation with each carriage 164. The carriage 164 includes the wheels 150 and the movable shelf support 78.

The center section of the hat shaped rail 158 supports the track 100 and the free outwardly turned edges 162, or flanges, of the hat shaped rail 158 serve as a guide for the wheels 150 mounted on a carriage 164 supporting a gear 108. It is the contact between the edges 162, or flanges, of the hat shaped rail 158 and the wheels 150 that substantially restrict the horizontal or tilting movement of the carriage 164 50 that the carriage 164 moves in a substantially vertical manner, i.e. with substantially no lateral deviation as it moves up and down the track 100. Thus, the carriage 164 moves in a substantially vertical direction. The combination of the hat shaped rail 158 and the carriage 164 comprises a stabilizing assembly. Each carriage 164 su ports the worm gear 74 so that rotation of the rod 148 rotates the gear 108 which in turn moves the carriage 164 and shelf 50 up or down as was explained in connection with FIG. 1.

FIG. 12*a* is a front view of one of the carriage 164 showing the wheels 150, the gear box 64, and the gear 108.

It is important to note that many configurations can be constructed from the ideas presented. For example, multiple lifting mechanism 56, more than one shelf 50, and more than one movable panel assembly 80 can be incorporated into a protected display case 22.

What is claimed is:

1. A protected display case providing security for exhibiting items and for storing items when items are not on display comprising:

a) a top section having at least one viewing window and defining a top volume;

b) a bottom section having a peripheral wall with opposing sides defining a bottom volume;

c) an access opening between the top and bottom volumes;

d) a shelf disposed within the display case and adapted to receive items for viewing, the shelf having a raised position in which the items on the shelf are in the top volume and available for viewing through the viewing window and a lowered position in which the shelf and items are disposed within the bottom volume;

e) a lifting mechanism disposed within the bottom section and comprising a pair of vertically aligned guides disposed along opposing sides of the peripheral wall of the bottom section, each guide includes a track having track teeth, a motor disposed under and carried by the shelf, a gear assembly carried by the shelf and coupled between the motor and the tracks, so that operation of the motor causes the shelf to move in relation to the tracks from the lowered to the raised position and visa versa;

f) a movable panel assembly having a retracted position in which the access opening is unobstructed and a deployed position in which the movable panel assembly substantially covers the access opening; and g) at least one door situated on the protected display case such that the items on the shelf can be accessed.

2. The protected display case as in claim 1 wherein the movable panel assembly includes a plurality of individually hinged panels and at least one roller, the hinged panels being stored on said roller when the panel assembly is in a retracted position.

3. The protected display case as in claim 2 wherein the protected display case has opposing sides, a front, a back, a top, and a bottom and the movable panel assembly moves in a direction from one side toward the opposing side.

4. The protected display case as in claim 3 further comprising switches for limiting the movement of the movable panel assembly and the lifting mechanism, and a motor for transitioning the movable panel assembly into a closed position, and a roller assembly having a biased spring for transitioning the movable panel assembly into an opened position.

5. The protected display case as in claim 2 wherein the protected display case has a manual control panel adapted to activate an alarm.

6. The protected display case as in claim 2 wherein the shelf has sides including a flexible peripheral band adapted to bend when contacting an obstruction adjacent an edge of the shelf when being raised or lowered.

7. The protected display case as in claim 6 wherein the movable panel assembly is adapted to respond to obstruction in the access opening and the movable panelassembly stops closing when an obstruction is detected.

8. The protected display case of claim 1 wherein the gear assembly includes a pair of shafts carried by the shelf each shaft having one end coupled to the motor and the other end coupled through gearing to the gear teeth on each respective track.

9. The protected display case of claim 8 wherein the gear assembly further includes a gear box carried by the shelf and coupled between the motor and said one end of each shaft.

10. The protected display case of claim 9 wherein the gearing between the other end of each of the shafts and the track teeth comprise a cog wheel and worm gear.

11. the protected display case of claim 10 wherein the gear box is coupled to said one end of each shaft via a U-joint.

12. The protected display case of claim 1 wherein the gear assembly comprises:

a) a gear box having a first and second output and the motor an the gear box being disposed on the bottom of the shelf and the motor being connected to the gear box, the gear box being part of the gear assembly;

b) a U-joint connected to each output of said gear box;

c) a rod connected to each U-joint;

d) a coupling connected to each rod opposing the U-joint;

e) a second rod connected to each coupling;

f) a worm gear connected to the second rod;

g) a gear adapted to receive the worm gear;

h) a gear housing containing the gear and worm gear and the gear housing being secured to the shelf, and i) track teeth being part of the track that work in conjunction with the gear such that when the motor is operating the motor causes the gear box to operate thereby rotating the U-joint, rod, coupling, second rod, and worm gear to operate and the worm gear and in turn causes the gear to operate and the gear engage the track teeth causing the shelf to move in relation to the track.

13. The protected display case of claim 1 further including a hat shaped rail mounted on each opposing side of the bottom section and a carriage mounted under the shelf adjacent each guide, the carriage having at least two wheels for engaging the sides of the associated has shape rail, the hat shaped rails operating in conjunction to keep the shelf in a substantially horizontal position while the shelf is moving or in a stationary position.

* * * * *